US006112489A

United States Patent [19]

Zweig

[11] Patent Number: 6,112,489

[45] **Date of Patent: *Sep. 5, 2000**

[54] MONOCOQUE CONCRETE STRUCTURES

[75] Inventor: Peter J. Zweig, Houston, Tex.

[73] Assignee: Monotech International, Inc., Reno, Nev.

[ * ] Notice: This patent is subject to a terminal disclaimer.

[21] Appl. No.: 09/024,121

[22] Filed: Feb. 17, 1998

Related U.S. Application Data

[63] Continuation-in-part of application No. 08/928,398, Sep. 12, 1997, abandoned, and a continuation-in-part of application No. 08/570,754, Dec. 12, 1995, Pat. No. 5,771,649.

[51] Int. Cl.[7] ..... E04B 2/02

[52] U.S. Cl. ..... 52/405.1; 52/293.3; 52/309.7; 52/309.11; 52/309.12; 52/309.14; 52/309.16; 52/309.17; 52/351; 52/354; 52/379; 52/405.3; 52/404.2; 52/780; 52/745.1; 52/745.13

[58] Field of Search ..... 52/293.3, 300, 52/309.7, 309.11, 309.12, 309.14, 309.15, 309.16, 309.17, 351, 354, 379, 405.1, 405.3, 404.2, 780, 745.1, 745.13

[56] References Cited

U.S. PATENT DOCUMENTS 2,315,895 4/1943 Crom .
2,324,554 7/1943 Billner .

(List continued on next page.)

OTHER PUBLICATIONS

The Dow Chemical Company, Stucco on Styrofoam, Brand Insulation, 6–page brochure.
The I.C.E. Block, Super Insulated Concrete Building System, 5–page brochure.
Insteel Construction Systems, Inc., Insteel 3–D Panel System, 2–page brochure.
Insulating Concrete Form Association, Insulating Concrete Forms . . . , 4–page brochure.
Portland Cement Association, Concrete Soutions, 8–page brochure.
Reddi–Form, Inc., Reddi–Form, Stay–In–Place Insulated Wall Forming System, 8–page brochure.
Western Insulfoam, Insulform, Insulated Concrete Form Wall System, 4–page brochure.
Berendsohn, Roy, "Home Improvement Rock Solid," Popular Mechanics, Home & Shop Journal (Feb. 1995) 4pages.
Hi–Tech Foam Products, Inc., "Pre–Cast Catalog," 8 pages.

*Primary Examiner*—Christopher T. Kent
*Attorney, Agent, or Firm*—Venable; Robert Kinberg

[57] ABSTRACT

A monocoque concrete structure includes a core structure comprised of foam panels presenting opposite sides and arranged in a desired shape of the monocoque concrete structure. A layer of concrete is applied to each of the opposite sides of the core structure to form a double monocoque concrete structure having a load bearing concrete shell on each of the opposite sides of the core structure.

46 Claims, 12 Drawing Sheets

U.S. PATENT DOCUMENTS

| | | | |
|---|---|---|---|
| 2,335,300 | 11/1943 | Neff . | |
| 2,645,929 | 7/1953 | Jones | 52/405.3 |
| 3,225,413 | 12/1965 | Bird et al. . | |
| 3,255,562 | 6/1966 | Altschuler . | |
| 3,410,044 | 11/1968 | Moog . | |
| 3,552,076 | 1/1971 | Gregori . | |
| 3,619,432 | 11/1971 | Harrington . | |
| 3,653,170 | 4/1972 | Sheckler . | |
| 3,676,973 | 7/1972 | Kellert . | |
| 3,782,049 | 1/1974 | Sachs . | |
| 3,800,015 | 3/1974 | Sachs . | |
| 4,002,707 | 1/1977 | Oram . | |
| 4,041,671 | 8/1977 | Nicholson . | |
| 4,067,165 | 1/1978 | McMillan . | |
| 4,069,629 | 1/1978 | Piazza . | |
| 4,080,767 | 3/1978 | Wilhelm . | |
| 4,094,110 | 6/1978 | Dickens et al. . | |
| 4,128,975 | 12/1978 | Abate . | |
| 4,138,833 | 2/1979 | Townsend . | |
| 4,170,093 | 10/1979 | Capellini et al. . | |
| 4,193,931 | 3/1980 | Arato . | |
| 4,249,354 | 2/1981 | Wynn . | |
| 4,253,288 | 3/1981 | Chun | 52/309.11 X |
| 4,292,783 | 10/1981 | Mulvihill | 52/309.12 X |
| 4,342,180 | 8/1982 | Gibson et al. . | |
| 4,365,455 | 12/1982 | Braine . | |
| 4,439,967 | 4/1984 | Dielenberg . | |
| 4,454,702 | 6/1984 | Bonilla-Lugo et al. . | |
| 4,489,530 | 12/1984 | Chang | 52/309.12 X |
| 4,510,724 | 4/1985 | Magnuson . | |
| 4,614,071 | 9/1986 | Sams et al. . | |
| 4,678,157 | 7/1987 | Fondiller . | |
| 4,884,382 | 12/1989 | Horobin . | |
| 4,890,993 | 1/1990 | Wilson . | |
| 4,894,969 | 1/1990 | Horbin . | |
| 5,014,480 | 5/1991 | Guarriello et al. . | |
| 5,024,035 | 6/1991 | Hanson et al. . | |
| 5,058,345 | 10/1991 | Martinez . | |
| 5,086,600 | 2/1992 | Holland et al. . | |
| 5,119,606 | 6/1992 | Graham | 52/309.12 X |
| 5,123,222 | 6/1992 | Guarriello et al. . | |
| 5,335,472 | 8/1994 | Phillips . | |
| 5,404,685 | 4/1995 | Collins . | |
| 5,522,194 | 6/1996 | Graulich . | |
| 5,588,272 | 12/1996 | Haponski . | |
| 5,617,686 | 4/1997 | Gallaher, Jr. . | |
| 5,771,649 | 6/1998 | Zweig | 52/309.12 X |

MONOCOQUE CONCRETE STRUCTURES

CROSS REFERENCES TO RELATED APPLICATIONS

This application is a continuation-in-part of U.S. patent application Ser. No. 08/928,398 filed Sep. 12, 1997 now abandoned, which is a continuation-in-part of application Ser. No. 08/570,754, filed Dec. 12, 1995, which is now U.S. Pat. No. 5,771,649, the disclosures of which are incorporated herein by reference.

BACKGROUND OF THE INVENTION

The invention relates to concrete construction and in particular to a monocoque concrete construction wherein a layer of fortified concrete applied to a core structure of expanded foam forms a load bearing shell.

According to the monocoque concrete construction technique described in my prior U.S. patent application Ser. No. 08/570,754, now U.S. Pat. No. 5,771,649, light weight foam blocks or panels are arranged on a previously formed concrete foundation to form the various walls, floors and/or roof of the house. Openings for doors and windows are cut into the foam panels and subsequently the foam panels are sprayed or hand troweled on both sides with fortified concrete to form a double monocoque concrete structure. The concrete contains polymer additives to facilitate adhesion to the foam panels and the foundations, and also contains fibers and other additives to increase the concrete flexural and impact strength as well as toughness, fatigue, strength and resistance to cracking. Once set, the concrete forms monocoque shells which constitute load bearing shells for the house structure while the foam panels with their excellent insulating characteristics are sandwiched between the monocoque concrete shells.

In the course of further developing the double monocoque concrete construction technique, it has been discovered that a variety of conventional construction materials can be integrated with the double monocoque concrete panels to provide added strength to the various construction components, such as the walls, floors and roof, and to provide greater versatility for forming the details of the housing structure including door and window openings, while maintaining the low cost nature of the housing and optimizing the time required to complete the finished structure.

SUMMARY OF THE INVENTION

It is an object of the invention to provide the monocoque concrete construction technique with increased versatility while maintaining the low cost nature of the construction.

It is a further object to integrate conventional construction materials with the monocoque concrete construction technique to improve the strength of the structure and to form details of the construction.

The above and other objects are accomplished according to the invention by the provision of a monocoque concrete structure, including a core structure comprised of foam panels presenting opposite sides and arranged in a desired shape of the monocoque concrete structure, and a layer of fortified concrete on each of the opposite sides of the core structure to form a double monocoque concrete structure having a load bearing concrete shell on of each of the opposite sides of the core structure.

In a preferred embodiment, the core structure includes a framework holding the panels in place prior to application of the concrete. The framework may include H-track studs and/or C-track studs which are preferably made of metal. In addition to holding the foam panels in place, the framework serves to transfer a load between the monocoque concrete shells. Load transferring mechanisms in place of or in addition to the Htrack and C-track studs which may be essentially characterized as end pieces disposed at opposite sides of the foam and at least partially embedded in a respective one of the concrete shells and a cross piece extending across a width of the foam panels and connecting the end pieces.

According to a further aspect of the invention, there is provided a wall (which could be either a free standing wall or a wall of a dwelling or other structure) comprising a monocoque concrete structure as described above wherein the wall is supported on a concrete foundation. In one embodiment of the wall, a plurality of C-tracks studs are fixed to the foundation with the flanges of the C-track stud extending upwardly and defining a channel which receives the bottom end of the foam panels. In a preferred embodiment of the wall according to the invention, a plurality of space a H-track studs are embedded in the concrete foundation and extend vertically. The respective ends of adjacent foam panels are received by the oppositely opening channels of the H-tracks stud. In other embodiments, the H-track studs may be replaced by posts embedded in the foundation and which abut respective ends of adjacent foam panels. Alternatively, gaps between ends of adjacent panels may be filled by concrete ends, possibly with the addition of wire mesh, wherein the concrete in the gap forms an integral connection with the monocoque concrete shells on the sides of the foam panels.

According to a further embodiment of the invention, the foundation for the wall may include separate, spaced apart footings and the core structure includes vertically oriented studs each embedded in a respective one of the footings. The foam panels include outer foam panels that sandwich the studs there between. Inner foam panels fill a gap formed between the outer foam panels by the spacing of the vertical studs.

According to a further aspect of the invention, the wall has an opening for receiving a window frame. C-track studs embrace the vertical edges of the foam panels bordering the opening to which the vertical window jams are attached. The monocoque concrete shells overlap the legs of the C-tracks.

According to yet another aspect of the invention, the wall includes an opening for receiving a door frame. H-tracks receive respective vertical edges of the foam panels bordering the door opening. The channel of the H-tracks studs facing one another have fastened therein wood studs for forming the door jams.

According to another aspect of the invention, there is provided a method of constructing a building which includes utilizing the monocoque concrete structure as described above as a load bearing wall component of the building. In another aspect of the invention method, the building is constructed from hybrid materials including utilizing the monocoque concrete structure as described above for at least one load bearing component of the building and further utilizing conventional materials, including, for example, wood for another one of the load bearing components of the building.

Other objects, features and advantages of the invention will become apparent from the following detailed description of the invention when taken in conjunction with the accompanying drawings.

DETAILED DESCRIPTION OF THE INVENTION

Figure 1:
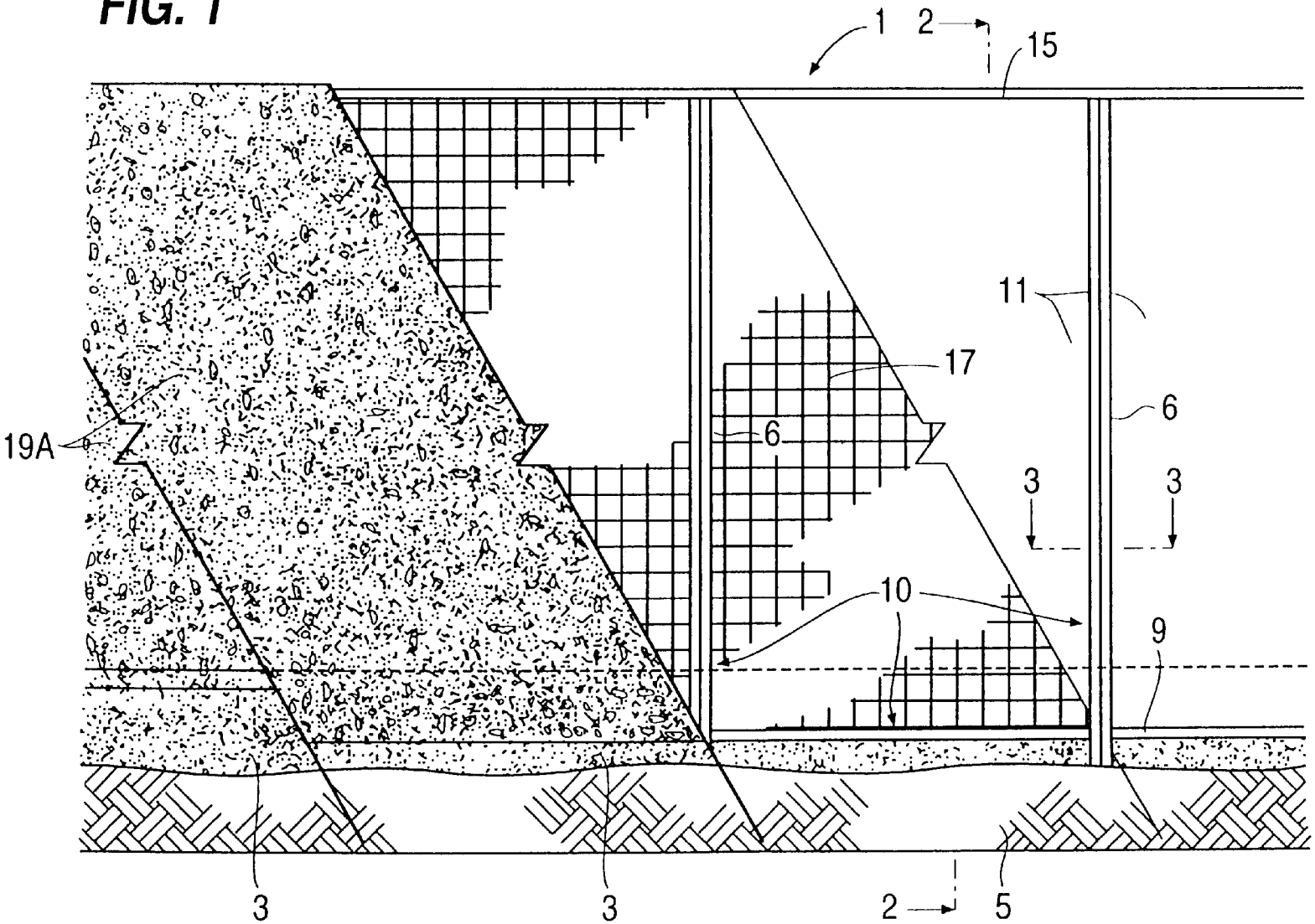
FIG. 1 is a front elevation, partially cut away, of a double monocoque concrete wall constructed according to the invention.

The invention is described below by way of embodiments which should be considered illustrative only and not as limiting the scope of the invention which is defined by the appended claims. The double monocoque construction techniques can be variously applied to construct stand alone walls, exterior and interior house walls, floors and roofs. A stand alone wall is relatively non-complex, yet embodies a number of features of the invention which are commonly employed in house walls, floors and roofs. Therefore, the embodiment of the stand alone wall will be described first. Common elements in the Figures will be referred to by the same reference numerals.

Figure 3A:
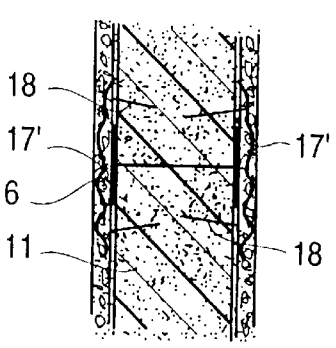
FIG. 3A is a sectional view similar to FIG. 3 showing a further variation within the scope of the invention.
Figure 3:
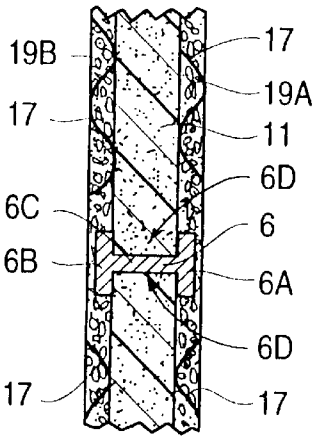
FIG. 3 is a sectional view along section line 3—3 in FIG. 1.
Figure 2A:
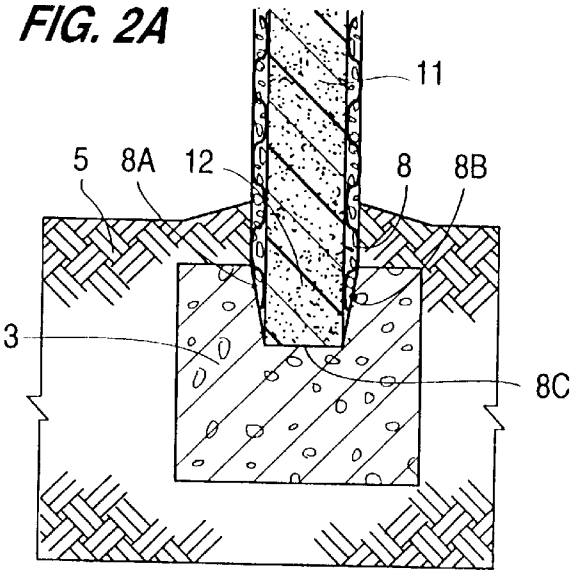
FIG. 2A is a sectional view similar to FIG. 2 showing a modified embodiment of a double monocoque wall according to the invention.
Figure 2:
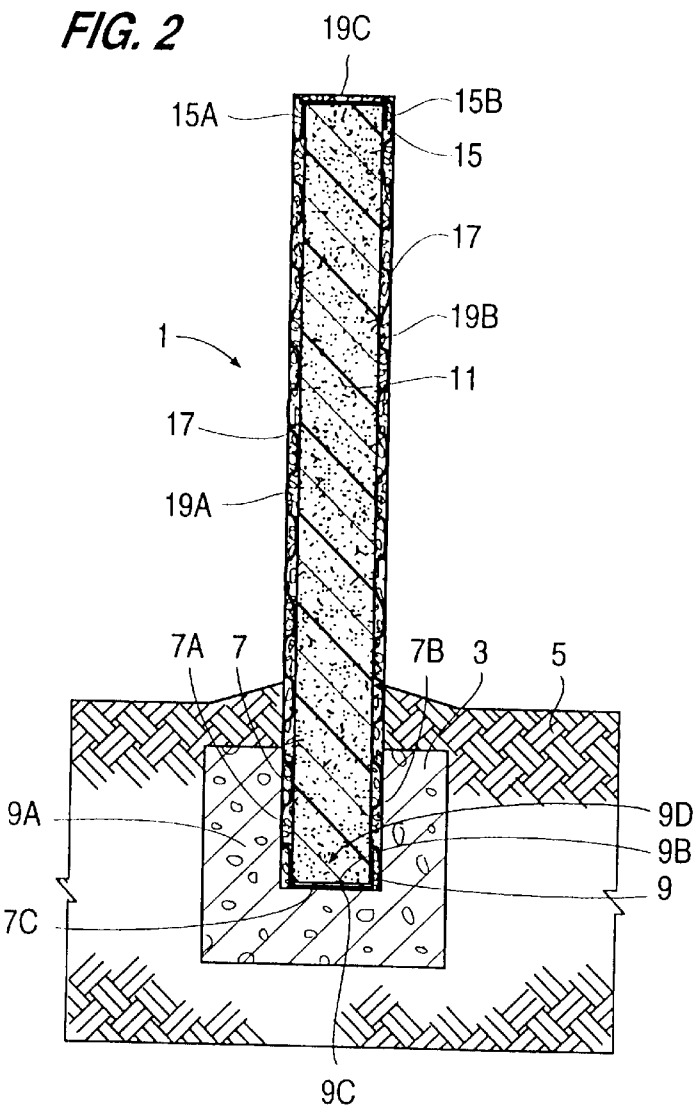
FIG. 2 is a sectional view along section line 2—2 in FIG. 1.

Referring to FIGS. 1–3, there is shown a wall 1 constructed in accordance with the principles of the invention. Wall 1 is supported by a concrete footing 3 comprised of commercial grade concrete previously set in the earth 5. Footing 3 is provided with a longitudinal recess 7 having side walls 7A and 7B, and a bottom 7C having a depth below the surface of ground 5 which varies but is generally on the order of about two feet. A plurality of conventional 4 inch metal H-track studs 6 (hereafter "H-tracks" are set vertically in concrete footing 3 spaced apart, for example, by about 4 feet. As shown in FIG. 3, each H-track has flanges or end pieces 6A and 6B connected by a web or cross piece 6C to define oppositely opening channels 6D which open in the longitudinal direction of groove 7. After concrete footing 3 is set, a conventional 4 inch metal C-track stud 9 (hereafter "C-track"), having side walls 9A, 9B connected by a bottom 9C to define a channel 9D, has its bottom 9C fixed to bottom 7C of groove 7, by concrete nails (not shown), between each pair of spaced apart H-tracks 5, with side walls 9A and 9B extending upwardly. Channels 6D of each pair of adjacent H-tracks and channel 9D of the C-track between each pair of adjacent H-tracks are connected together to form a continuous panel groove 10 having a U-shape in a vertical plane in the longitudinal direction of the footing. Into each continuous panel groove 10 there is inserted a 4 inch thick and four foot wide foam panel 11 which is received by the respective channels 6D of adjacent H-tracks and channel 9D of the C-track disposed there between. Foam panels 11 may be made of conventional expanded polystyrene foam and are commercially available.

The top edges of panels 11 are cut to be flush with the top edges of H-tracks 6 and are embraced by further metal C-tracks which have their side walls 15A, 15B extending downwardly for creating a channel into which the top edges of panels 11 are received. H-tracks 6, together with C-tracks 9 and 15 form a framework for holding and foam panels 11 and together with the foam panels form a core or inner shell having the desired shape of the concrete wall to be formed.

A reinforcing wire mesh 17 may optionally be tacked to the vertical surfaces of panels 11 to provide added strength as is understood in the art. Concrete is then applied, for example by spraying or troweling to the side and top surfaces of the core of the wall to form concrete side shells 19A, 19B capped by a top shell 19C.

The concrete used to form shells 19A, 19B and 19C is preferably a cement based, fortified concrete containing a sand aggregate without coarse gravel and a polymer based additive which includes fibers made from, for example, steel, plastic, glass or other materials, which serve the purpose of improving the concrete flexural strength, impact strength, toughness, fatigue strength and resistance to cracking. The polymer acts as an adhesive to aid in the adhesion of the concrete against the foam panels and to help minimize slump. The polymers may include thermal plastic and elastomeric latexes and/or epoxies. Latex improves ductility, durability, adhesive properties, resistance to chlorideion ingress, shear bond and tensile as well as flexural strength of the concrete. Latex modified concrete can also be used. Latex modified concrete has excellent freeze-thaw abrasion and impact resistance. Some latex modified concrete materials can also resist certain acids, alkyl and organic solvents. A commercially available concrete additive having suitable characteristics for implementing the present invention is available from Monotech International, Inc. under the brand name MONOCRETE. A cement based concrete having such an additive can be applied to a thickness of about ⅜ of an inch to about 1 inch. Concrete shells 19A, 19B, when set constitute load bearing shells on opposite sides of foam panels 11. H-tracks 6 and C-tracks 9 and 15 operate, among other things, to transfer loads between concrete shells 19A and 19B. From a mechanical standpoint, wall 1 is analogous to an I-beam structure wherein concrete shells 19A, 19B constitute the flanges of the I-beam and the H-tracks and C-tracks operate in the manner of the web of the I-beam for transferring a load between the flanges as will be understood by those skilled in the art.

FIG. 2A is a cross section similar to FIG. 2 showing a modified embodiment wherein the C-tracks 9 are omitted and foam panels 11 have their bottom regions 12 wedged into recess 8 extending in the longitudinal direction of the foundation. For this purpose, recess 8 has opposing side surfaces 8A and 8B sloping toward one another in a direction toward a bottom surface 8C of the recess 8. In this embodiment, panels 11 may have adjacent edges coupled together by H-tracks 6 as in the embodiment of FIG. 1.

FIG. 3A is a cross section similar to FIG. 3 which shows another variation wherein a wire mesh strips 17' are tacked with nail fasteners over the flanges of H-tracks 6. Such wire mesh strips may be used with or without wire mesh screens 17 shown in FIG. 1.

Figure 5:
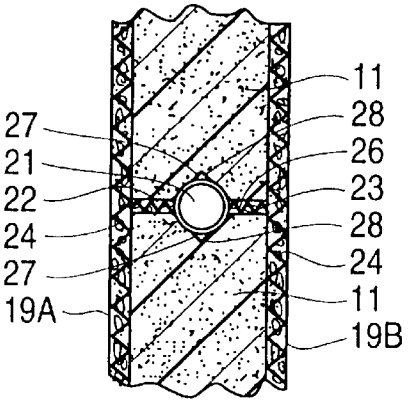
FIG. 5 is a partial sectional view along section line 5—5 in FIG. 4.
Figure 4:
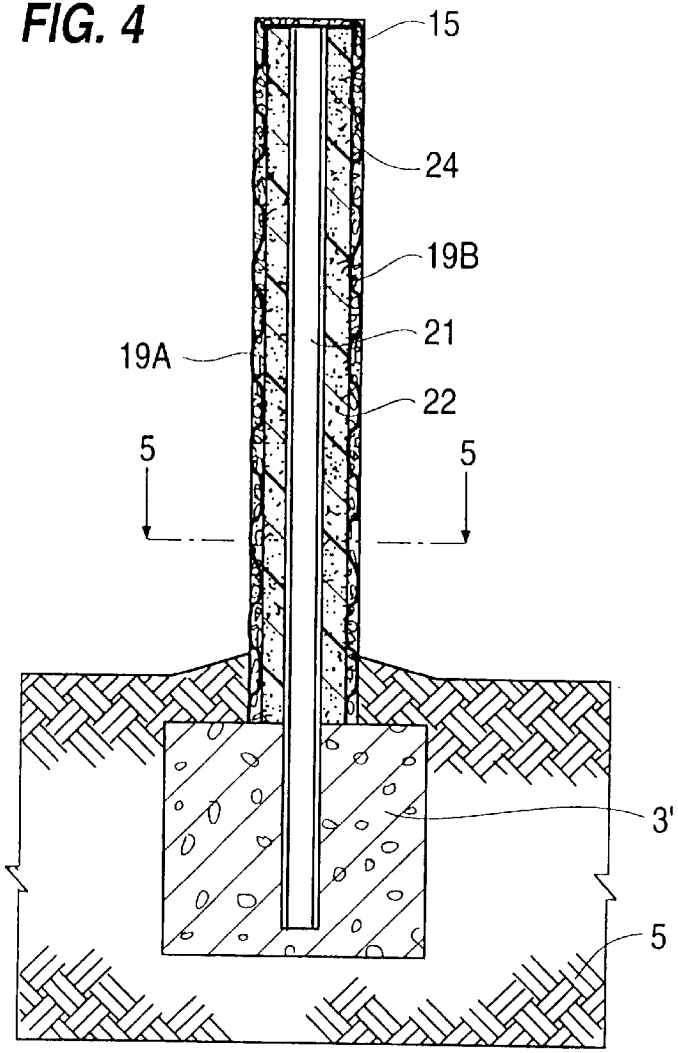
FIG. 4 is a vertical sectional view of a double monocoque concrete wall through a post according to another embodiment of the invention.

FIGS. 4 and 5 illustrate another embodiment of a wall constructed according to the invention wherein the H-tracks in the embodiment of FIGS. 1–3, are replaced by a system including a tubular metal post 21, concrete 22 which fills a gap 23 of approximately ½ inch between the vertical edges of panels 11 and a strip of wire mesh or screen 24 which is placed flushed against panels 11 covering gap 23 and which becomes embedded in concrete shells 19A, 19B applied to the side walls of panels 11. A wire mesh 26 may also be placed in gap 23 on both sides of post 21. As can be seen from FIG. 4, post 21 is embedded in the concrete footings 3', and is received by grooves 27 formed by angled notches 28 in the respective vertical edges of panels 11. The concrete in gap 23 together with post 21 and wire mesh 26, have comparable mechanical properties of H-tracks 6 shown in FIGS. 1–3 for transferring loads between concrete shells 19A, 19B of a double monocoque wall construction according to the invention.

Figure 6:
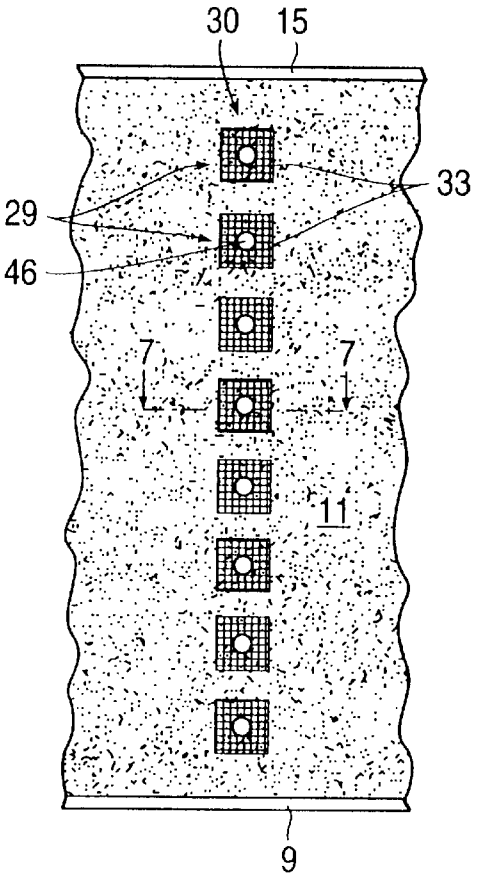
FIG. 6 is a partial front elevational view of a double monocoque concrete panel employing load transfer pins according to a further embodiment of the invention.
Figure 7:
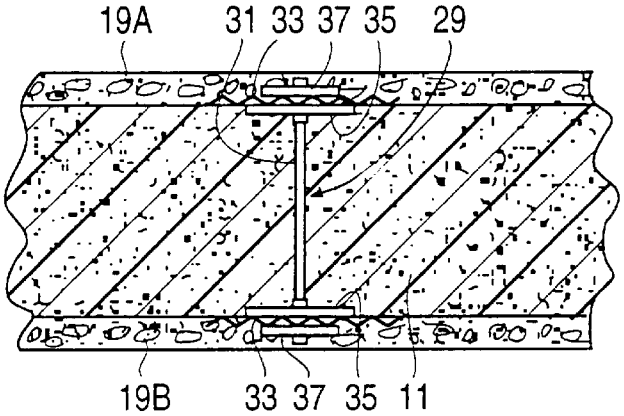
FIG. 7 is a sectional view taken along section lines 7—7 in FIG. 6.

FIGS. 6 and 7 illustrate another embodiment for transferring loads between concrete shells 19A, 19B of a double monocoque wall constructed according to the invention. This embodiment employs a plurality of load transfer pins 29 spaced apart in a vertical column 30 between the top and bottom of wall 1 having a core comprised of a foam panel 11 embraced by bottom and top C-tracks 9 and 15, respectively. The respective columns of load transfer pins may be spaced apart horizontally by approximately four feet, and may be employed in addition to, or in some cases, in place of its H-tracks for transferring load between the monocoque concrete shells.

Load transfer pins 29 each comprise a pin or rod 31 extending through foam panel 11 and projecting through the surface of foam panel 11 at each side, with a piece of wire mesh 33, for example in the shape of a square, sandwiched between a metal washer 35 and a one way retaining washer 37 at each end of pin 31. The wire mesh and washers are embedded in the concrete when it is applied to the surface of the foam panel. Load transfer pins 29 collectively serve to transfer a load between concrete shells 19A and 19B.

Figure 8:
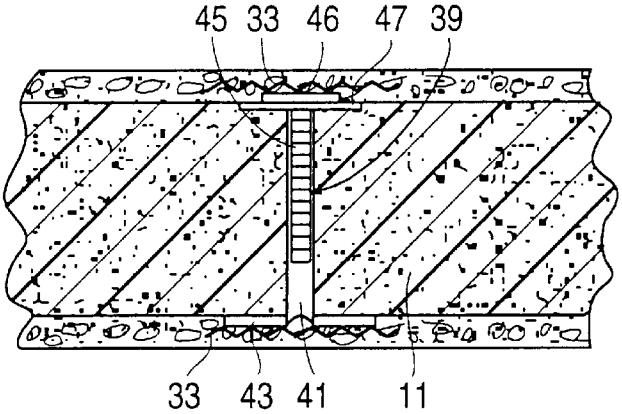
FIG. 8 is a similar sectional view as in FIG. 7 according to another embodiment of the invention.
Figure 9:
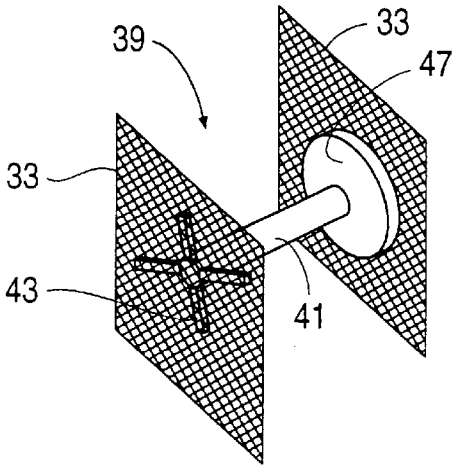
FIG. 9 is a perspective view of the load transfer pin according to the embodiment illustrated in FIG. 8.

FIGS. 8 and 9 show a further embodiment for load transfer pins. Each load transfer pin 39 includes a square or round tube 41 which has a splayed end presenting radially extending tabs 43 and having another end which projects through panel 11 and receives an alignment pin 45 from the other side of panel 11. Alignment pin 45 has a flat end 46 for retaining a metal washer 47. Squares of reinforcing fabric or wire mesh 33 may be tacked with fasteners (not shown) to foam panels 11 over the end of load transfer pins 39 as shown, or sandwiched between the foam panel and the ends of pins 39 in a manner similar to that shown in FIG. 7.

Figure 10:
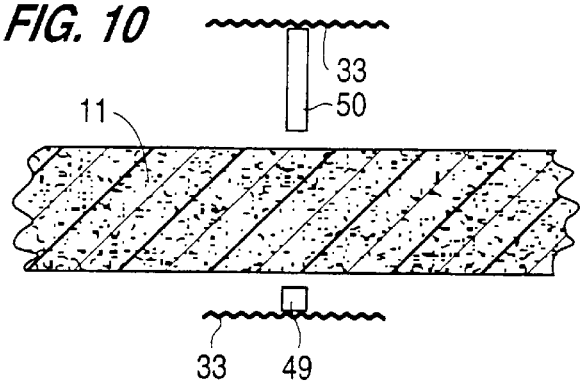
FIG. 10 is an exploded top view showing a foam panel and a load transfer pin according to another embodiment of the invention.
Figure 11:
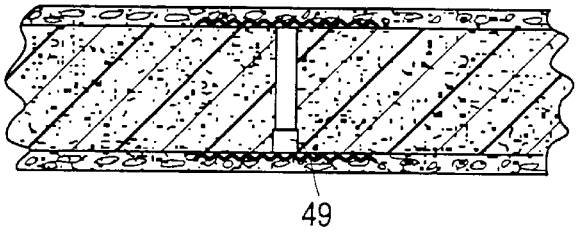
FIG. 11 is a sectional view similar to that shown in FIGS. 7 and 8 showing the load transfer pin illustrated in FIG. 10 in an assembled state in a double monocoque concrete wall.

FIGS. 10 and 11 show a modified embodiment for load transfer pins wherein a retainer tube 49 coupled to a piece of reinforcing mesh 33 at one end penetrates foam panel 11 from one side and a pin 50 having reinforcing mesh 33 attached to one of its ends penetrates with the other end foam panel 11 and is received in a coupling fashion by retaining tube 49 at the other side of the panel.

Figure 12:
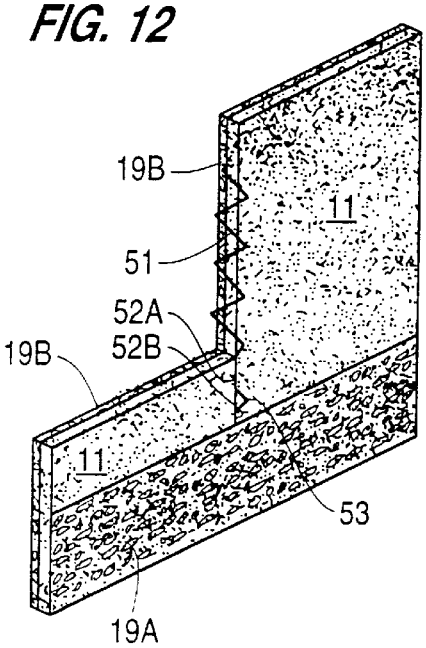
FIG. 12 is a perspective view, partially cut away, of a double monocoque concrete construction panel illustrating yet another embodiment of load transfer pins.

FIG. 12 shows yet another embodiment for transferring a load between the monocoque concrete shells. In FIG. 12, a wire 51 having a zig zag shape extending in a vertical plane and is sandwiched between adjacent vertical edges of adjacent foam panels 11. Angled portions 53 of zig zag wire 51 are formed by the change of direction of the wire protruding beyond the surface of panels 11 and are embedded in the concrete applied to panels 11 to form concrete shells 19A, 19B.

Figure 13:
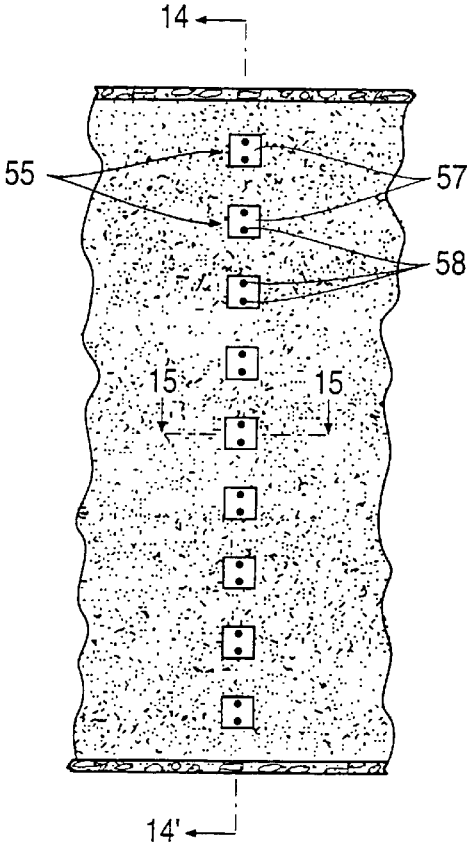
FIG. 13 is a partial front elevational view of a double monocoque concrete construction panel with load transfer pins according to another embodiment of the invention.
Figure 14:
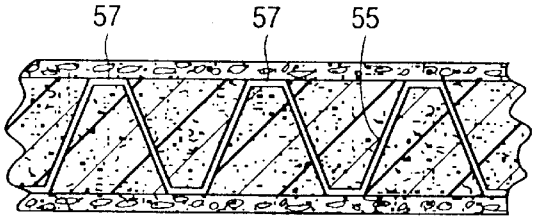
FIG. 14 is a sectional view along section line 14—14 shown in FIG. 13.
Figure 15:
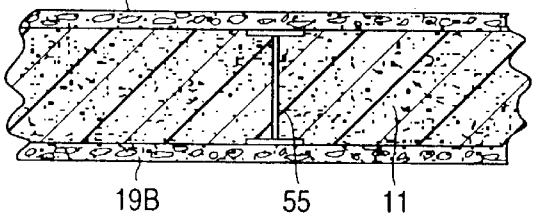
FIG. 15 is a sectional view shown along section line 15—15 in FIG. 13.

FIGS. 13–15 show a still further embodiment for transferring load between the concrete shells. In this embodiment, load transfer pins 55 are connected together by plates 57 to form a truss. The load transfer pins are each disposed at 45 degrees to the plane of the foam panel and have their ends connected to the respective plates 57 by nuts 58 which are threaded on to the ends of the pins. Preferably, plates 57 are partially recessed into a depression in the foam panel face.

Figure 18:
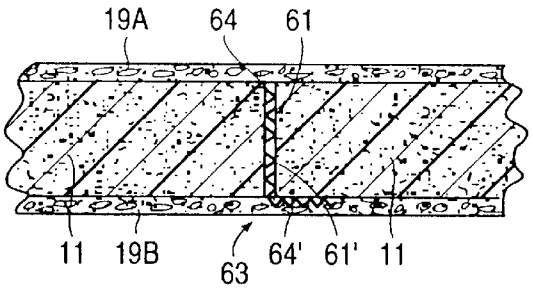
FIGS. 16–18 show similar views as FIGS. 13–15 according to a still further embodiment of the invention.
Figure 16:
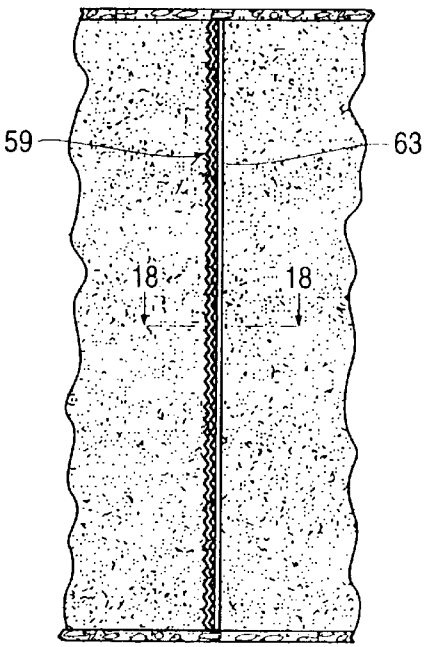
Figure 17:
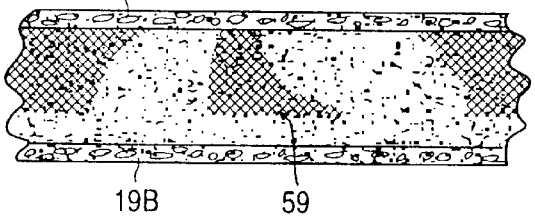

FIGS. 16–18 show yet another embodiment for transferring a load between the monocoque concrete shells. Here, a strip of wire mesh which is bent along a longitudinal line to form a "corner" mesh 59 having one leg 61 disposed in a gap 63 between adjacent panels 11 and the other leg 64 disposed flush against the surface of one of the adjacent panels 11. A similar corner mesh having legs 61' and 64' is inserted into gap 63 from the other side of the foam panels. The remainder of gap 63 is then filled with concrete which becomes integral with the concrete layer forming the respective concrete shells 19A, 19B.

Figure 20:
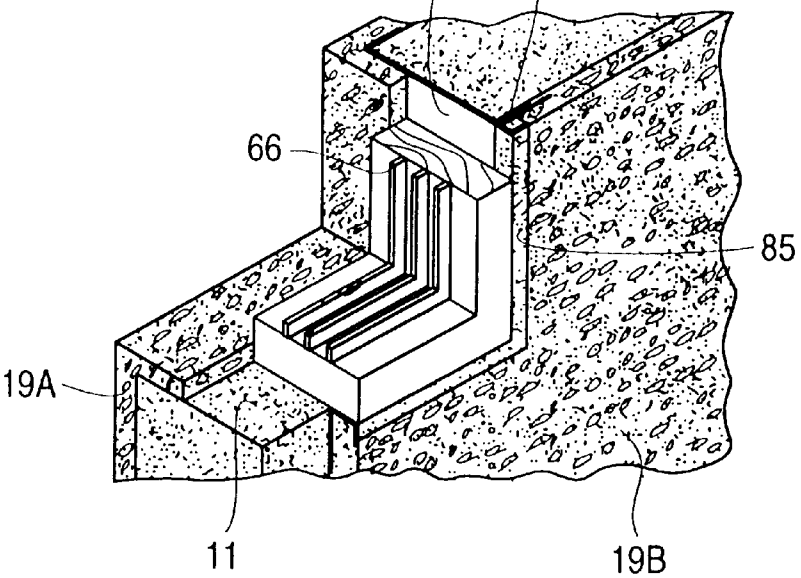
FIG. 20 shows a perspective view, partially cut away, partially in section, of an enlarged finished corner area of the window frame shown in FIG. 19.
Figure 19:
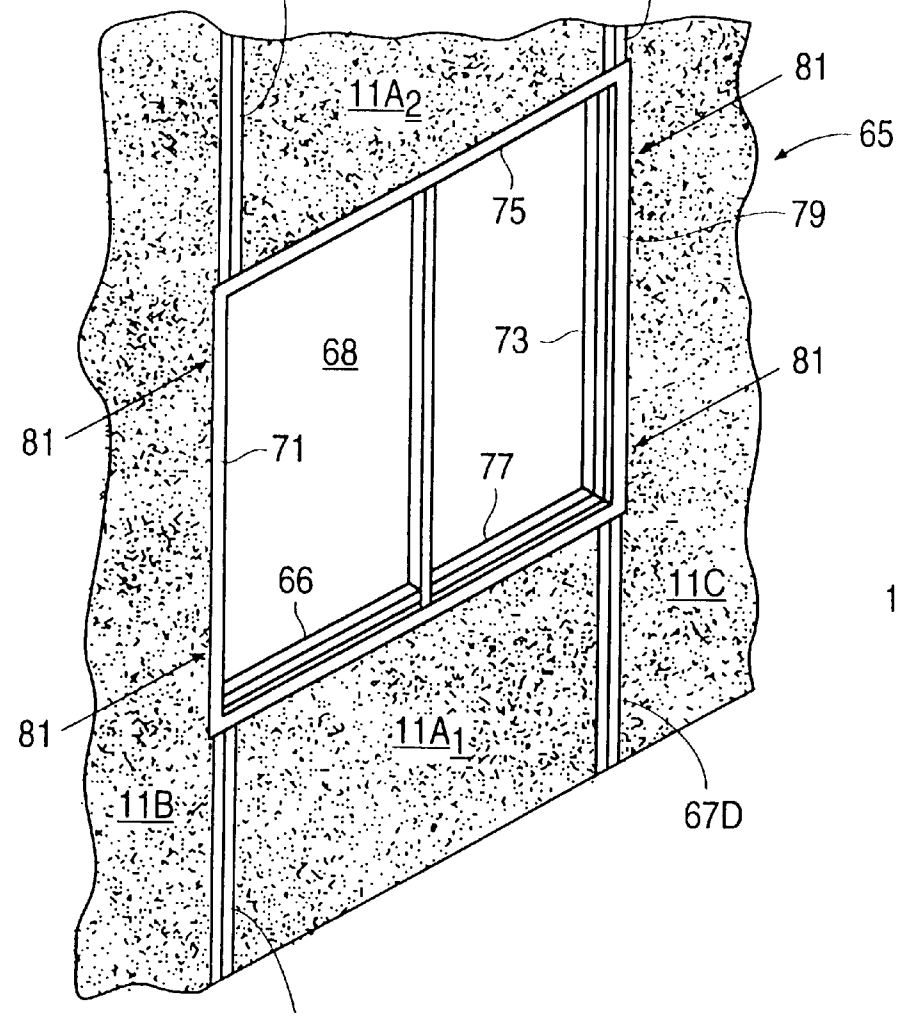
FIG. 19 is a perspective view showing, in an intermediate stage of construction, a window formed in double monocoque concrete construction panels according to a further aspect of the invention.

FIGS. 19 and 20 illustrate a construction detail for forming a window in a double monocoque concrete wall formed according to the invention. FIG. 19 shows a wall 65 in an intermediate stage of construction and containing an opening 68 in which a window frame 66 is mounted. Foam panels $\mathbf{11}A_1$ and $\mathbf{11}A_2$ are vertically spaced apart to form opening 68. Respective H-tracks 67A, 67B, 67C and 67D are disposed between vertical edges of panels $\mathbf{11}A_1$ and $\mathbf{11}A_2$, on the other hand, and the vertical edges adjacent panels 11B and 11C, on the other hand, in a manner similar to that illustrated in FIGS. 1 and 3. In a vertical space between H-tracks 67A and 67B and in a similar vertical space between H-tracks 67C and 67D, there are arranged C-tracks. A portion of the right hand C-track 69 is visible in FIG. 20.

Window frame 66 has oppositely disposed window jams 71, 73, a header 75 and sill 77 which are adapted to hold one or more panes of glass. A radially extending mounting flange 79 surrounds the entire window frame and has fastening recesses through which fasteners such as screws 81 may be inserted for fastening the window frame to the legs of the respective C-tracks 69. A groove 83 by a J-shaped channel piece 85 surrounds the window frame. Concrete applied to the surface of foam panel 11 to form monocoque concrete shell 19B fills channel 83 to provide a finished look and to augment the fastening of window frame 66 in the perimeter of opening 68.

Figure 22:
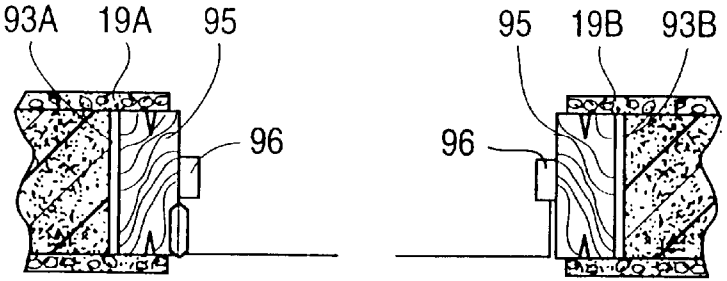
FIG. 22 is a sectional view along section line 21—21 in FIG. 21, and additionally showing the concrete shells of the finished construction.
Figure 23:
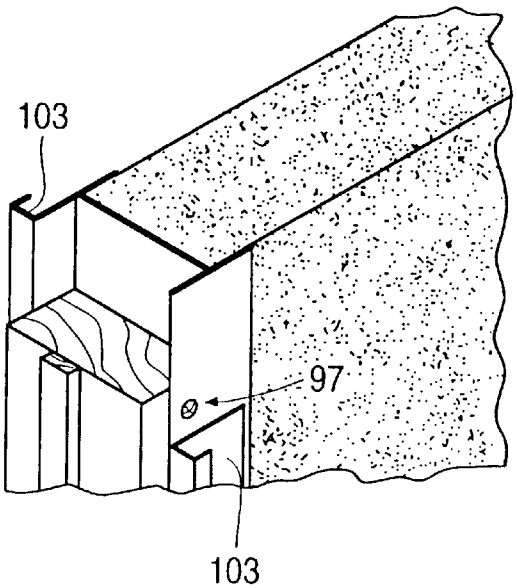
FIG. 23 is an enlarged perspective view, partially in section, partially cut away, of a door jam of the door depicted in FIGS. 21 and 22.
Figure 21:
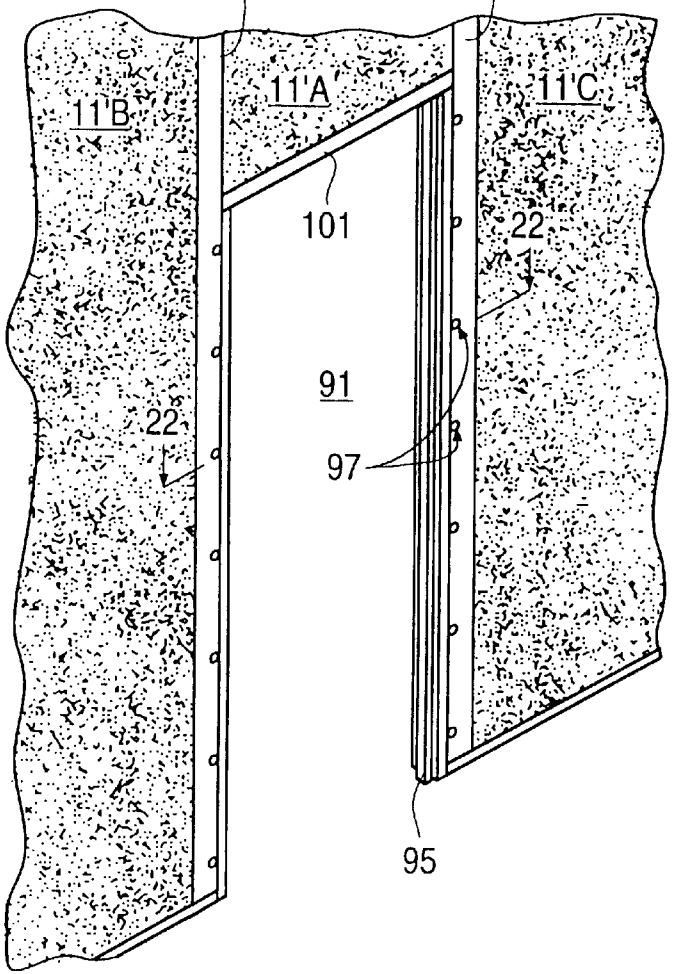
FIG. 21 is a perspective view showing, in an intermediate stage of construction, a door formed in double monocoque concrete construction panels according to a further aspect of the invention.

FIGS. 21–23 illustrate construction details for forming a door in a double monocoque concrete wall according to the invention. In FIG. 21, a portion of a panel 11'A is cut away to form a door opening 91. Panel 11A is coupled to panels 11'B and 11'C. by way of H-tracks 93A, 93B. H-tracks 93A and 93B extend upwardly from the floor and are utilized to form opposing door jams by inserting in the channels of H-tracks 93A and 93B which face each other, 2-by-4 wood studs 95 by way of screws or nails which are inserted through openings provided in the legs of the H-tracks. A strip 96 having a rectangular cross section smaller than the cross section of the wood studs 95 is fixed to each stud 95 to form door stops. At the top of door opening 91, a C-track 101 may be fastened to the lower edge of panel 11A to form a header for the door opening. A bead or J-shaped channel piece 103 may be attached to one or both flanges of the H-track so that concrete applied to the surface of the panel may fill the groove of bead 103 to provide a finished look and further stabilize the door jams.

Figure 25:
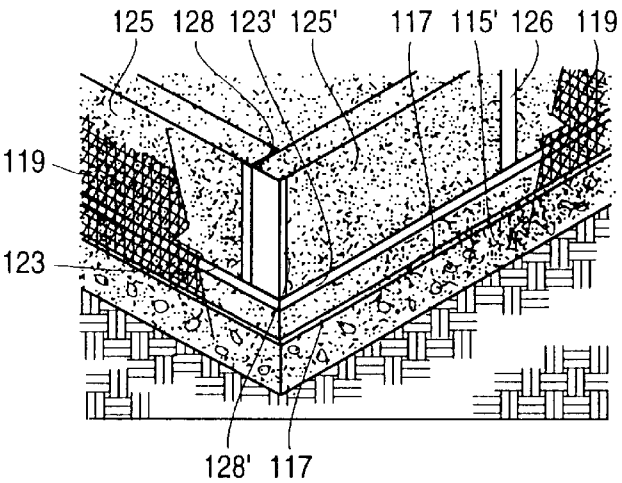
FIG. 25 is a partial perspective view, partially cut away, partially in section, of two double monocoque concrete construction walls coming together at a corner and mounted on a foundation according to the embodiment illustrated in FIG. 24.
Figure 24:
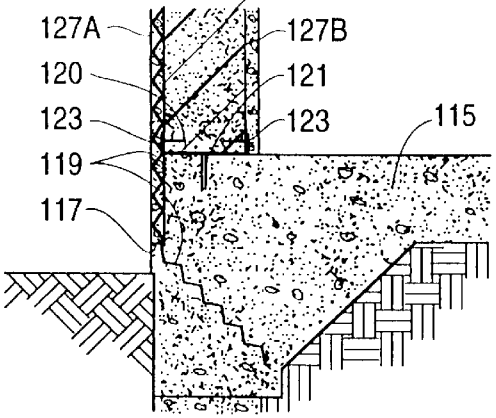
FIG. 24 is a partial sectional view of a double monocoque concrete wall supported by a concrete foundation according to a further aspect of the invention.

FIGS. 24 and 25 shows construction details for attaching a double monocoque concrete wall constructed according to the invention to a concrete slab for forming the exterior wall of a structure such as a house. As shown in FIG. 24, a concrete slab 115 is formed having a continuous ledge 117 around its perimeter. A wired mesh 119 is embedded in the concrete slab and emerges from the slab at the inside corner of ledge 117 and extends out a sufficient length to be embedded in an exterior concrete shell to be formed. A C-track 120 is fixed to slab 115 by concrete nails 121 with its legs 123 extending upwardly. Foam panels 125 are inserted in C tracks 120 and are coupled together at their vertical edges by H-tracks 126 as previously described (See FIG. 25). Concrete is applied to each side of the foam panels to form exterior and interior concrete shells 127A, 127B, respectively. Exterior concrete shell 127A has embedded therein the projecting portion of wire mesh 119 to tie the wall so formed to slab 115 in a sturdy manner. FIG. 25 shows an intermediate stage of construction including foam panels 125, 125' supported on a foundation 115' by way of C-tracks 123, 123' and coming together to form a corner. Vertical C-tracks 128, 128' terminate the ends of the foam panels. Wire mesh 119 is embedded in the foundation and has a portion projecting from ledge 117 which is tacked to the foam panels and becomes embedded in the concrete subsequently applied to the sides of the foam panels.

Figure 27:
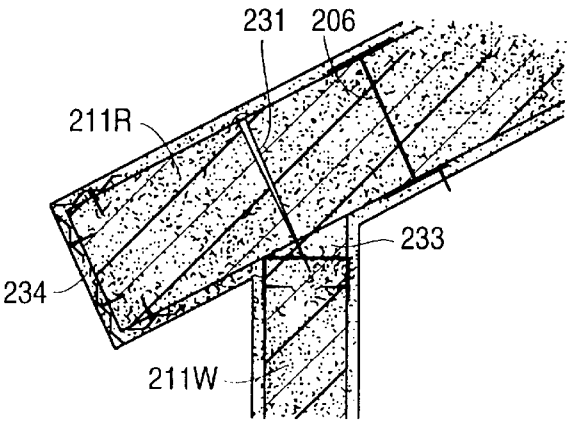
FIG. 27 is a vertical sectional view showing a finished wall and roof made according to the double monocoque concrete construction technique of the invention.
Figure 26:
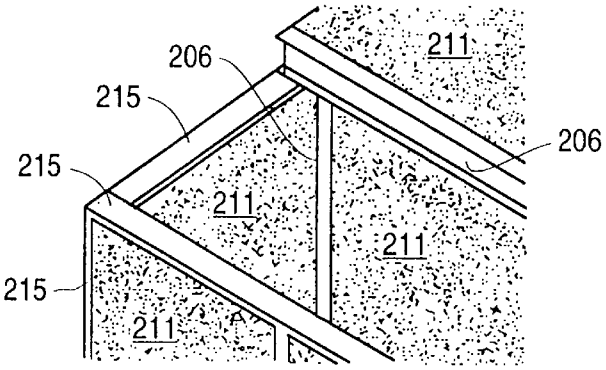
FIG. 26 is a partial perspective view of an intermediate stage of construction stage of wall and roof panels using the double monocoque concrete construction techniques according to the invention.

FIGS. 26 and 27 show examples of wall and roof detail utilizing the double monocoque concrete construction technique according to the present invention. FIG. 26 is a partial view of an intermediate stage of construction wherein the core of the walls and roof are formed by foam panels 211 coupled together by H-tracks 206. The exposed top and end edges are capped by C-tracks 215. FIG. 27 shows a vertical sectional view of a finished wall and roof. A roof foam panel 211R is shown fixed by pins 231, one of which is shown in FIG. 27, to a wall foam panel 211W. A wedge of foam 233 may be inserted in a gap formed by the angled roof panels 211R where it meets and overlaps wall panels 211W. The exposed ends of roof panel 211R may be reinforced with wire mesh 234. Concrete is applied to the surfaces of roof panels 211R and the surfaces of wall panels 211W to form double monocoque concrete wall and roof panels according to the invention.

Figure 29:
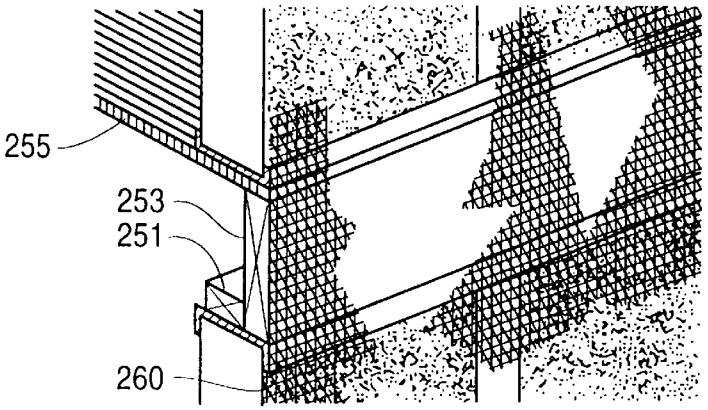
FIG. 29 is a partial perspective view, partially in section, of an intermediate construction stage of the hybrid construction shown in FIG. 28.
Figure 28:
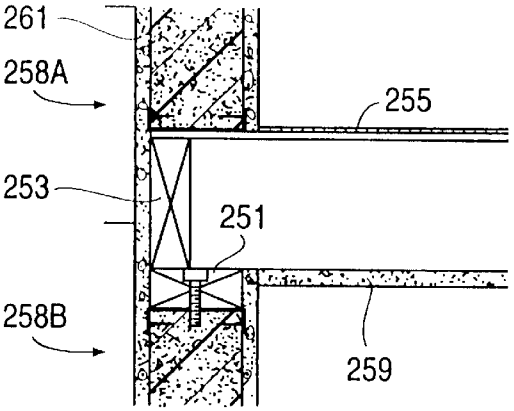
FIG. 28 is a vertical sectional view of walls and an intermediate floor and ceiling employing double monocoque concrete construction together with other material in a hybrid construction according to a further aspect of the invention.

The double monocoque concrete construction panels according to the present invention may be further combined with conventional materials such as wood and wood sheathing to form various hybrid constructions. For example, FIGS. 28 and 29 show a hybrid construction wherein wood headers 251 and wood joists 153 supporting a wood sheathing floor 255 are disposed between exterior double monocoque concrete walls 258A, 258B in a multi-level construction. Additionally, joists 253 have traditional sheet rock 259 attached to their underside to form a finished ceiling for the first level of the structure. As can be seen from FIG. 29, a reinforcing wire mesh 260 may be employed on the exterior surface to bridge the foam panels and wood before applying the concrete to form the exterior concrete shell 261 to minimize cracking due to different coefficients of expansion of the materials with changes in temperature.

Figure 31:
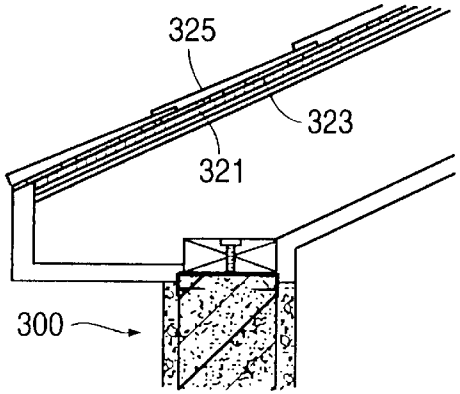
FIG. 31 is a vertical sectional view of the hybrid wall and roof construction shown in FIG. 30 in a final stage of construction.
Figure 30:
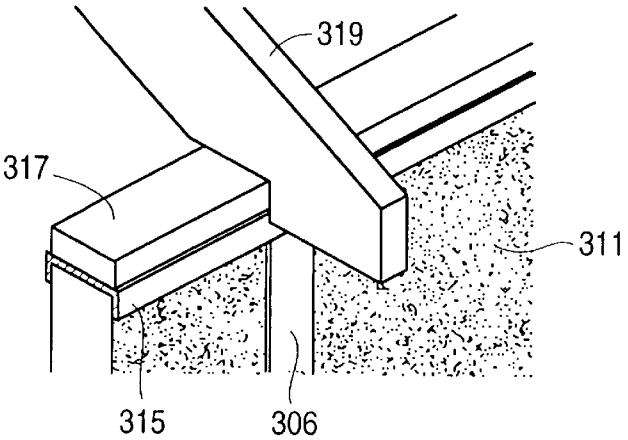
FIG. 30 is a partial perspective view, partially in section, of an intermediate construction stage of a wall and roof employing hybrid construction according to another aspect of the invention.

FIGS. 30–31 show a hybrid roof system in which a traditional wood roof employing conventional roofing rafters, sheathing, felt and shingles is built on a structure having double monocoque concrete walls. FIG. 30 shows an intermediate stage of construction including foam panels 311 coupled together by an H-tracks 306 and capped on their top edge by a C-track 315. A wood header 317 is fixed by appropriate screw fasteners to C-track 315 and the wood rafters 319 are fixed to header 317 in a traditional manner. Thereafter, wood sheathing 321, felt 323 and wood or asphalt shingles 325 are installed in the usual way. The entire roofing system is supported by the double monocoque concrete walls 300 as previously described.

Figure 32:
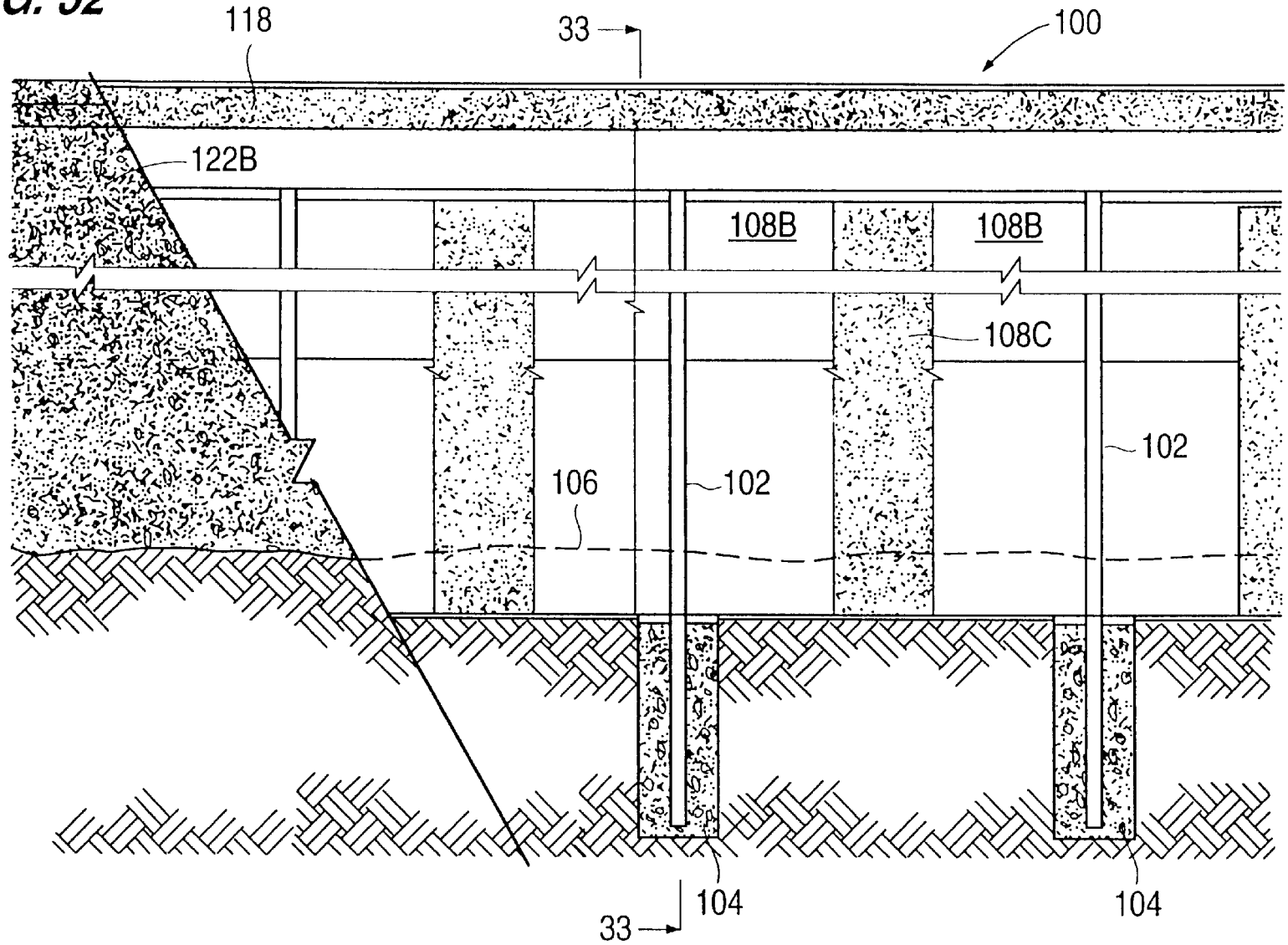
FIG. 32 is a front elevation, partially cut away, of a double monocoque concrete wall constructed according to another embodiment of the invention.
Figure 33:
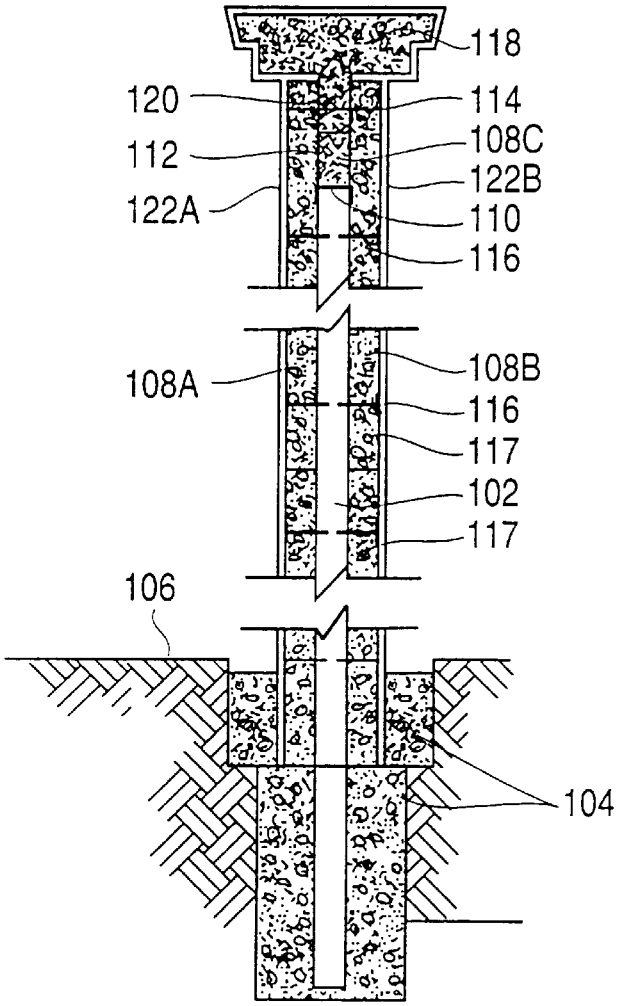
FIG. 33 is a sectional view along section line 33—33 in FIG. 32.

FIGS. 32 and 33 show another embodiment for a wall employing the double monocoque construction techniques of the invention. This embodiment is distinguished by a reduction in the overall cost of construction due to a reduction in the amount of concrete required for the foundation and by utilizing a minimum framework supporting the foam panels in the core structure prior to application of the concrete layers that form the monocoque shells.

Referring to FIG. 32 there is shown a double monocoque concrete wall 100 that is formed by embedding galvanized metal studs 102 with a vertical orientation in individual concrete footings 104. The upper surfaces of concrete footings 104 are preferably 8 inches or so below local grade 106. Metal studs 102 may be spaced apart, for example, four feet on center. As may be appreciated more clearly from FIG. 33, metal studs 102 are sandwiched between outer foam panels 108A and 108B, each of which may be two inches thick. Metal studs 102 have a top end which is terminated by a light gauge metal C-track 110 which runs horizontally in the longitudinal direction of the wall to provide stability to the metal studs while they are being set in the concrete footings. Panels 108A and 108B desirably extend upwardly beyond C-track 110. As can be seen in the cross-section of FIG. 33, outer panels 108A and 108B are separated by the width of vertical studs 102, thus creating a gap 112 between the outer panels. Gap 112 can be seen above the metal studs in FIG. 33 where it is shown filled with a foam panel 108C. Gap 112 also exists between adjacent vertical studs 102 below the level of the C-track 110 although it is not visible in the drawings. The gap formed by outer panels 108A and 108B between adjacent metal studs 102 is likewise filled by inner foam panels which are not visible in the drawings. Inner foam panels 108C may also be two inches thick. The inner and outer foam panels are secured together by foam-to-foam retaining pins 114. Additionally, the outer panels are secured to the metal studs by self tapping screws 116 which pass through washers 117, for example three inch diameter plastic washers. Optionally, a foam cap 118 may be employed to terminate the top end of the wall. For this purpose, cap 118 is provided with a T-shaped projection 120 which fits into gap 112 at the top end of the wall. The outer surfaces of the core structure are then coated with approximately a one half inch layer of a fortified concrete mixture as previously described which when set, forms a double monocoque concrete structure having load bearing concrete shells 122A and 122B on opposite sides of the core.

Figure 34:
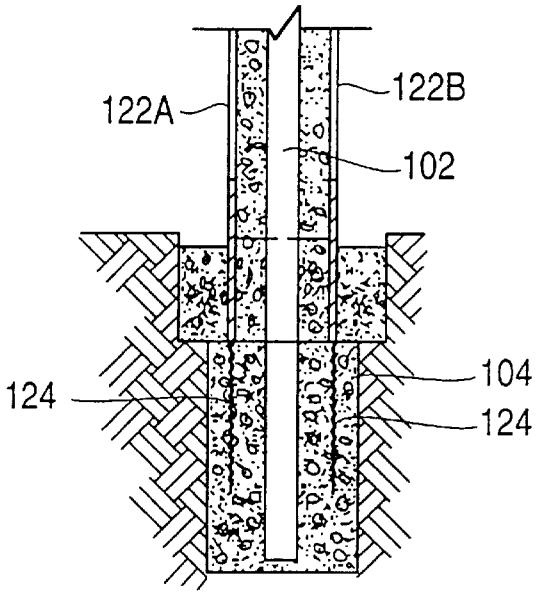
FIG. 34 is a sectional view similar to FIG. 33 showing a further modification.

FIG. 34 illustrates a further modification of the wall depicted in FIGS. 32 and 33 wherein a reinforcing wire mesh 124 is embedded in concrete footing 104 on both sides of the wall and projects upwardly for being imbedded in concrete shells 122A and 122B. The embedded wire mesh 124 augments the wall strength and allows for a decrease in the size of the vertical metal studs.

Various modifications are possible within the scope of the invention. For example, the channels of the H-track and C-track studs, used in some of the embodiments to form the core structure of a wall, may have a width that is less than the thickness of the foam panels, so that if the foam panel has a thickness of 4 inches, the H-track or C-track stud may have a channel width of, for example, 2.5 inches. In this case, the end of a foam panel would be embraced by the channel of the H-track or C-track such that one flange of the H-track or C-track stud would hug the outer surface of one side of the foam panel, while the other flange forming the channel would fit into a linear groove cut into the end surface of the foam panel. A portion of the foam panel would then overlap such other flange.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A monocoque concrete structure, comprising:

a core structure comprised of foam panels presenting opposite sides and arranged in a desired shape of the monocoque concrete structure; and a layer of concrete on each of the opposite sides of the core structure to form a double monocoque concrete structure having a load bearing concrete shell on each of the opposite sides of the core structure.

2. The monocoque concrete structure as defined in claim 1, wherein the core structure includes a framework holding the foam panels in place prior to application of the concrete.

3. The monocoque concrete structure as defined in claim 2, wherein the framework includes H-track studs presenting oppositely opening channels receiving respective ends of adjacent foam panels.

4. The monocoque concrete structure as defined in claim 3, wherein the H-track studs are comprised of metal.

5. The monocoque concrete structure as defined in claim 2, wherein the core structure includes C-track studs presenting a channel receiving a free end of one of the foam panels.

6. The monocoque concrete structure as defined in claim 5, wherein the C-track studs are comprised of metal.

7. The monocoque concrete structure as defined in claim 2, wherein the framework comprises means for transferring a load between the concrete shells.

8. The monocoque concrete structure as defined in claim 7, wherein the transferring means comprises end pieces disposed on opposite sides of the foam and at least partially embedded in a respective one of the concrete shells and a cross piece extending across a width of the foam panels and connecting the end pieces.

9. The monocoque concrete structure as defined in claim 8, wherein the transferring means comprises at least one C-track stud having a channel receiving an end of one of the foam panels.

10. The monocoque concrete structure as defined in claim 8, wherein the transferring means comprises at least one H-track stud having oppositely opening channels each receiving a respective end of adjacent foam panels.

11. The monocoque concrete structure as defined in claim 1, and further including means for transferring a load between the monocoque concrete shells.

12. The monocoque concrete structure as defined in claim 11, wherein the transferring means includes end pieces disposed on opposite sides of the foam and at least partially embedded in a respective one of the concrete shells and a cross piece extending across a width of the foam panels and connecting the end pieces.

13. The monocoque concrete structure as defined in claim 12, wherein the cross piece comprises at least one rod and the end pieces extend radially from the rod.

14. The monocoque concrete structure as defined in claim 13, wherein the cross piece includes a plurality of rods aligned in a plane.

15. The monocoque concrete structure as defined in claim 14, wherein the rods form an angle of approximately 90 degrees with the surfaces of the foam panels.

16. The monocoque concrete structure as defined in claim 14, wherein the rods form an angle departing substantially from 90 degrees with the surfaces of the foam panels.

17. The monocoque concrete structure as defined in claim 11, wherein the cross piece includes at least one tube.

18. The monocoque concrete structure as defined in claim 17, wherein the tube includes at least one splayed end that comprises one of the end pieces.

19. The monocoque concrete structure as defined in claim 8, wherein the cross piece includes a continuous wire having a plurality of sections bent in opposing directions to form a zig-zag shape, each section extending across a thickness of the core and having portions projecting beyond the surfaces of the foam panel constituting the end pieces and embedded in a respective one of the load bearing concrete shells.

20. The monocoque concrete structure as defined in claim 11, wherein the transferring means comprises a structure having a shape of a truss.

21. The monocoque concrete structure as defined in claim 1, wherein the concrete shells each have a thickness in a range of about ⅜ inch to about 1 inch.

22. The monocoque concrete structure as defined in claim 11, wherein the foam panels include adjacent foam panels spaced apart to define a gap and the gap is filled with concrete which extends across a thickness of the adjacent foam panels and has an integral connection with each of the concrete shells.

23. A wall including the monocoque concrete structure as defined in claim 1, and further including a concrete foundation supporting the wall.

24. A wall as defined in claim 23, wherein the foundation is elongated in a longitudinal direction and further including a plurality of C-track studs fixed to the foundation, oriented in the longitudinal direction of the foundation, and including upwardly extending flanges defining a channel receiving a bottom end of the foam panels.

25. The wall as defined in claim 23, and further including a plurality of spaced apart H-track studs having one end embedded in the concrete foundation and extending vertically, wherein the H-track studs have oppositely opening channels that receive respective ends of adjacent foam panels.

26. The wall as defined in claim 23, and further including a plurality of spaced apart posts having one end embedded in the concrete foundation and extending vertically in a gap between ends of adjacent foam panels, and concrete filling a remaining space in the gap and having a integral connection with each of the concrete shells.

27. The wall as defined in claim 23, and further including a wire mesh embedded in the foundation, the wire mesh having a portion projecting from the foundation and embedded in at least one of the concrete shells of the wall.

28. The wall as defined in claim 23, wherein the foundation is elongated in a longitudinal direction and the foundation includes a top horizontal surface that is provided with a downwardly extending longitudinal recess defined by opposing surfaces parallel to the longitudinal direction of the foundation and sloping inwardly toward one another toward a bottom surface of the recess, wherein the foam panels have a bottom region that is wedged into the recess.

29. The wall as defined in claim 28, and further including wire mesh partially embedded in the foundation and partially embedded in at least one of the concrete shells.

30. A wall including the monocoque concrete structure as defined in claim 1, the wall having an opening for receiving a window frame presenting oppositely disposed vertical window jams, the opening being defined in width by oppositely disposed vertical edges of the wall, the wall further including C-track studs each having legs presenting a channel receiving a vertical edge of the foam panel at a respective one of the vertical edges of the wall for attachment of a corresponding one of the vertical window jams to the wall, wherein the concrete shells overlap the legs of the C-track studs.

31. A wall including the monocoque concrete structure as defined in claim 1, the wall having an opening for receiving a door frame presenting oppositely disposed vertical door jams, the opening being defined in width by oppositely disposed vertical edges of the wall, the wall further including H-track studs each having legs presenting first and second channels opening in opposite directions, the first channel of each H-track receiving a vertical edge of the foam panel at a respective one of the vertical edges of the wall, and further a wood stud fixed in a respective one of the second channels of the H-track studs for being fastened to a respective one of the vertical door jams.

32. A wall as defined in claim 23, wherein the foundation comprises spaced apart concrete footings, and the wall further includes vertical studs each embedded in a respective one of the concrete footings for providing an initial support for the foam panels prior to application of the concrete layers to the opposite sides of the core structure.

33. The wall as defined in claim 32, wherein the foam panels include outer foam panels sandwiching the vertical studs there between.

34. The wall as defined in claim 33, wherein the outer foam panels are separated from one another by a gap defined by a horizontal dimension of the vertical studs, and the wall further includes inner foam panels filling the gap.

35. The wall as defined in claim 34, and further including fasteners fixing the foam panels together prior to application of the concrete layers to the opposite sides of the core structure.

36. The wall as defined in claim 35, wherein the fasteners comprise pins fastening the foam panels to one another.

37. The wall as defined in claim 35, wherein the fasteners comprise screws connecting the outer foam panels to the vertical studs.

38. The wall as defined in claim 32, wherein the vertical studs have top ends and further including horizontal studs connecting the top ends of the vertical studs.

39. The wall as defined in claim 38, wherein the horizontal studs comprise C-track studs embracing the top ends of the vertical studs.

40. The wall as defined in claim 32, and further including reinforcing mesh material embedded in the concrete footings at least one of the concrete shells for reinforcing the wall.

41. A method of constructing a building, comprising utilizing the monocoque concrete structure of claim 1 as a load bearing wall in the building.

42. A method of constructing a building, comprising utilizing the monocoque concrete structure of claim 1 as a load bearing roof of the building.

43. A method of constructing a building, comprising utilizing the monocoque concrete structure of claim 1 as a load bearing floor of the building.

44. A method of constructing a building from hybrid materials, comprising utilizing the monocoque concrete structure of claim 1 for at least one load bearing component of the building.

45. The monocoque concrete structure of claim 1, wherein the concrete is fortified with fibers.

46. The monocoque concrete structure of claim 1, wherein the concrete is fortified with adhesives.

* * * * *